US006350355B1

(12) United States Patent
Cloostermans-Huwaert

(10) Patent No.: US 6,350,355 B1
(45) Date of Patent: Feb. 26, 2002

(54) STARTING CATHODES MADE OF COPPER BAND FOR COPPER ELECTROLYSIS AND A METHOD FOR THE PRODUCTION THEREOF

(75) Inventor: Leon Raphael Lucienne G. Cloostermans-Huwaert, Maarkedal (BE)

(73) Assignee: Lamitref Industries N.V., Hemiksem (BE)

( * ) Notice: Subject to any disclaimer, the term of this patent is extended or adjusted under 35 U.S.C. 154(b) by 0 days.

(21) Appl. No.: 09/555,539

(22) PCT Filed: Sep. 23, 1999

(86) PCT No.: PCT/EP99/07070

§ 371 Date: May 31, 2000

§ 102(e) Date: May 31, 2000

(87) PCT Pub. No.: WO00/20661

PCT Pub. Date: Apr. 13, 2000

(30) Foreign Application Priority Data

Oct. 1, 1998 (EP) ..... 98118542

(51) Int. Cl.[7] ..... C25B 11/04

(52) U.S. Cl. ..... 204/280; 204/281; 204/292; 148/538; 148/541; 148/546; 148/551; 148/552; 148/554; 148/556; 148/557; 148/111; 29/527.7

(58) Field of Search ..... 204/292, 280, 204/281; 164/481, 482, 476, 485, 417; 148/538, 541, 546, 551, 552, 554, 556, 557, 111; 29/527.7

(56) References Cited

U.S. PATENT DOCUMENTS 5,286,315 A * 2/1994 Iwayama et al.

FOREIGN PATENT DOCUMENTS

| | | |
|---|---|---|
| EP | 0 417 318 | 3/1991 |
| GB | 1 294 694 | 11/1972 |
| WO | 97 42360 | 11/1997 |

* cited by examiner

*Primary Examiner*—Bruce F. Bell
(74) *Attorney, Agent, or Firm*—Collard & Roe, P.C.

(57) ABSTRACT

The object of this invention was to create starting copper cathodes which prevent a memory effect during copper electrolysis, achieving a high production output of electrolytic copper and which can also be manufactured from directly shaped copper sheeting material in the form of a coil. A suitable method of producing starting cathodes for processing copper sheet produced by conventional methods. The proposed starting cathodes are made of milled copper sheets with a thickness of 0.3 to 1.2 mm, is soft annealed after milling and has a strength of 210 to 240 N/mm$^2$. The copper sheet is cut to the length and width determined by the dimensions of the electrolysis bath and has a flat, fat-free, burless surface. Ear strips of copper sheet with a thickness of 0.3 to 0.6 mm are mounted on the suspension side.

17 Claims, No Drawings

STARTING CATHODES MADE OF COPPER BAND FOR COPPER ELECTROLYSIS AND A METHOD FOR THE PRODUCTION THEREOF

BACKGROUND

1. Field of the Invention

This invention concerns starting cathodes of copper strip for copper electrolysis and a method of producing these starting cathodes.

2. Prior Art

In copper electrolysis, the copper raw material which is produced by smelting metallurgy and has a purity of 99.0% to 99.8% is dissolved at the anode primarily as $Cu^{2+}$ and is deposited at the cathode as pure copper (high grade) with a high selectivity. Either thin substrates produced by electrolysis (starting sheets) or permanent cathodes of high-grade steel are used for cathodic deposition. The electrolytic copper produced by copper electrolysis has a purity of 99.95% to 99.99% and is used to manufacture semifinished products from this metal and its alloys.

The substrates used to produce starting sheets either consist of cold-milled polished copper, high-grade steel or titanium. The starting sheets are produced in so-called starting sheet baths. After electrolytic deposition on the starting sheets in a recurring rhythm of 24 hours, the deposited layers are separated either manually or by an automatic stripping machine. These sheets, which are known as substrates and correspond approximately in length and width to the anode and cathode dimensions are 0.5 to 1 mm thick and weigh approx. 4 to 7 kg. Preparation for starting sheets includes essentially cutting uneven, cracked edges, which may optionally be necessary, straightening and applying two mounting strips ("ears" of cut substrates or milled copper strip) to the cathode rod by means of an automatic riveting machine. This "starting sheet" production technology is out-of-date and is no longer economical. This has been a problem in the copper industry for a long time, because the demand for high-grade steel plate and the required high quality standard for starting sheets leads to high costs with regard to the cost of acquisition as well as the labor expenditure, power consumption and time consumed as well as leading to a high rate of waste in starting sheet production.

For example, the starting sheet will usually have a fixed dimension which is limited by the size of the electrolysis bath. Industrially, however, it is important for the starting sheet anode to have an optimum size because of the high costs of labor and energy in anode production and the reprocessing of anode residues after electrolytic metal deposition. However, the anode must have almost complete and uniform coverage of the starting sheet, so that in practice, the size of the anode is adapted to the size of the starting sheets and other process variables in order to lower production costs for starting sheets. This usually leads to the production of two types of anodes which differ in geometry:

starting sheet anodes and production anodes.

Starting sheet anodes also tend to bend or roll up and do not hang straight in the production bath due to lack of uniformity in thickness and due to the production method (stripping the substrates away from the starting sheet). Disadvantages include the unavoidable cracked edges due to the manufacturing process plus the fact that a smooth surface is not always guaranteed.

The known consequences include short-circuits leading to a low current efficiency and a reduction in production volume, associated with a negative effect on cathode quality.

Permanent cathodes made of high-grade steel are used with the copper refining process that has been introduced in the meantime under the name "ISA process." Copper is deposited on these cathodes usually over a period of seven days and is separated mechanically in the form of sheets by means of an automatic stripping machine.

The ISA process is very expensive and leads to high production costs for the refined copper. In addition, large inventories of high-grade steel plate is necessary for the ISA process, leading to additional storage and warehousing costs. Another disadvantage of the ISA process is that the starting sheets needed for electrolyte regeneration for decopperizing electrolysis must usually be purchased from third-party operations.

The profitability of copper electrolysis depends essentially on the quality of the copper sheets used as the starting cathodes and their production costs.

International patent WO 97/42360 describes a method of producing copper cathode starting sheets where refined copper is smelted and then processed through continuous casting and milling methods to form strips 0.635 mm to 1.778 mm thick (0.025 to 0.070 inch), which corresponds to a 25% to 98% reduction in the starting material thickness. This requires casting in a horizontal position and also conveying the sheets in a horizontal position to the reducing plant, a roll mill. The cast strip obtained in the first process step should have a thickness of 5.08 to 38.1 mm (0.2 to 1.5 inch). In addition, it is essential for the milled strip not to be rolled or otherwise deformed during or after milling to rule out the possibility of the so-called memory effect (a horizontal curvature of a few mm) in use as starting sheets. The memory effect is the main cause of short circuits that occur during copper electrolysis.

The starting sheets are cut out of the milled strip and fabricated in a known way for the electrolysis process.

SUMMARY OF THE INVENTION

This proposed procedure for producing copper cathode starting sheets is very expensive due to the high installation costs. The installation is designed for the usual width dimensions of the starting cathodes and is intended only for production of starting cathodes. Based on approximately 200,000 tons per year and the annual demand of approximately 35 tons of starting cathodes per year for utilization of capacity. Therefore, the production costs of starting cathodes is very high. In addition, this method is limited to processing refined copper. Another disadvantage is that the milled copper strip for manufacturing the starting cathodes must not be rolled or otherwise deformed. Consequently, the milled copper strip cannot be rolled up into a coil but instead must be stored and transported only in the form of prefabricated cut sheets, or the milled sheets must be processed directly to starting cathodes within the production line. Another fear is that due to the deformation caused by the milling operation, it is impossible to rule out a memory effect of the starting cathodes during copper electrolysis. The aforementioned publication also does not mention any results documenting that no memory effect occurs in use of the starting cathodes produced in this way.

The object of this invention is to create starting cathodes from copper sheet for copper electrolysis that will rule out any memory effect during copper electrolysis, will permit a high production output of electrolytic copper and can also be produced from directly shaped copper sheet material in the form of a coil.

Furthermore, a suitable method of manufacturing the starting cathodes is to be created which is also suitable in particular for processing conventionally manufactured copper strip.

Through the process step of subjecting the milled copper sheet to an additional soft annealing process which is essential to this invention, it is possible to eliminate the memory effect which otherwise occurs when using starting cathodes in electrolysis. Therefore, there are far fewer short circuits during copper electrolysis and current efficiency is higher. Copper electrolysis can thus be performed more efficiently and with a higher cathode power. It is also advantageous to use the grades of copper according to DIN standards 1708, 1787 and 17670 which have a higher concentration of metallic impurities in comparison with electrolytic copper and refined copper. It has surprisingly been found that when using starting cathodes made of these grades of copper, the quantity of electrolytically deposited copper with a higher purity is greater. In comparison with the starting sheets used according to International Patent No. WO 97/42360 which must have a minimum thickness of at least 0.635 mm, experiments have shown that when using milled and soft annealed starting sheets, the sheet thickness can be reduced to a level of less than 0.5 mm, with 0.3 mm being the lower limit. In comparison with thicker starting sheets, this reduces the cost of materials and also makes it possible to use a larger number of starting cathodes in the electrolysis bath. This is possible in particular only because the milled and soft-annealed starting sheets do not lead to a memory effect. The incidence of short circuits has been greatly reduced by using the starting cathodes according to this invention in copper electrolysis, and a current efficiency of 98% to 99% has been achieved.

Due to the lower thickness of the starting sheets and their lower weight, the thickness of the copper sheet for ear strips can also be reduced to preferably 0.3 to 0.5 mm.

The stated strength of the copper sheet of 210 to 240 $N/mm^2$ is achieved by aftertreatment on a skin pass mill stand, for example.

Soft annealing of the milled copper sheet is performed at furnace temperatures of 700 to 750° C., preferably at 720 to 750° C., with the furnace temperature being reduced from 750° C. to 720° C. in the direction of passage. The speed of conveyance of the copper sheet through the furnace depends essentially on the sheet width and sheet thickness. For starting sheets for starting cathodes with a width of 930 mm and a thickness of 0.3 to 0.8 mm, this amounts to 20 to 55 m/min. Various technical options are available for performing the soft annealing process. The copper sheet can be produced in a traditional casting and milling installation and wound up as a coil. Then in a separate installation, the milling hard copper sheet is uncoiled, soft annealed in an annealing furnace, treated in a downstream degreasing and pickling unit (removing scale and oxides) and straightened in a straightening and partitioning installation and cut to the required length of 840 to 1250 mm. In this embodiment, pass milling of the copper sheet may be omitted. Then the ears are riveted on by means of a riveting and straightening machine and the contact rods are mounted. In a subsequent adjusting unit, the starting cathodes are separated, sorted and suspended in the prepared receptacle for the crane for suspending in the electrolysis bath. It is an important advantage that no separate installation is necessary for producing the starting sheets but instead this process starts from a soft annealed copper sheet produced by an essentially known method and optionally ordered from a third party.

This also applies to another variant according to which the mill-hard copper sheet is soft annealed while still in the casting and milling installation and then it is available as a soft annealed copper sheet in the form of a coil for further processing to produce starting cathodes. This coil is then uncoiled to produce the starting cathodes and supplied to the straightening and partitioning installation. Further processing then takes place as described above.

Furthermore, there is the possibility of manufacturing starting cathodes within one manufacturing line, and then the process steps of winding up and unwinding the coil of milled and soft annealed copper sheet may be omitted. Soft annealing of the milled copper sheet can be performed in an annealing furnace with a vertical or horizontal design. Before soft annealing, the copper sheet should be degreased, brushed, rinsed with water and dried. After annealing, it is expedient to pickle and neutralize the cooled copper sheet.

DETAILED DESCRIPTION OF THE PREFERRED EMBODIMENTS

This invention will now be illustrated below on the basis of a few examples.

Example 1

Starting Cathodes S1

SF-Cu was rolled on a traditional casting and rolling installation to form a copper sheet with a width of 930 mm and a thickness of 0.5 mm. The mill-hard copper sheet had a tensile strength of 263 $N/mm^2$ and was wound up in the form of a coil. In a separate installation consisting of an unwinding device, an annealing furnace, a degreasing and pickling unit, a straightening and partitioning installation and the finishing installation for the ears and contact rods, starting cathodes were manufactured under the following conditions.

The unwound mill-hard copper sheet was passed through a horizontal suspension belt furnace whose heating zones were adjusted to temperatures in the range of 750° C. to 720° C. The belt speed was 35 m/mm. Soft annealing was performed under a protective gas atmosphere. The soft annealed, cooled copper sheet had a tensile strength of 217 $N/mm^2$. After soft annealing, scale and oxide were removed in the degreasing and pickling unit. In the downstream straightening and partitioning installation, the copper sheet was cut into lengths of 970 mm, and the resulting starting sheets were straightened and dressed to 970×930 mm. It is important for the starting sheets that are sent for finishing to be completely flat and smooth, not to have any external damage, such as scratches, to be fat-free, oil-free and emulsion-free. The clean, dry starting sheets are conveyed to a riveting machine to attach the required ear strips which are made of 0.4 mm thick copper sheet, which is made of the same grade of material as the starting sheets. After attaching the ears to the starting sheets, the contrast rods are also mounted.

Example 2

Starting Cathodes S2

Within a traditional casting and rolling installation with an integrated suspended belt furnace as the last process step, mill-hard copper sheet made of SF-Cu is produced and wound up as a coil. The 930 mm wide, mill-hard copper sheet has a thickness of 0.635 mm after the milling operation. After the milling operation, the copper sheet is degreased, brushed, rinsed with clear water and dried. The mill-hard copper sheet then passes through a suspended belt furnace at a speed of 27.5 m/min, where the furnace temperatures are in the range of 750° C. to 720° C. The cooled copper sheet has a tensile strength of 217 N/mm$^2$. It is then pickled, neutralized, wound up into a coil and stored temporarily. In a separate installation, the soft annealed copper sheet coil is unwound and processed to form starting cathodes as described in Example 1 in a straightening and partitioning installation and in a finishing installation for the ears and contact rods. The sheet thickness of the ear s mounted on the starting cathodes is 0.5 mm.

Example 3

Starting Cathodes S3

Starting cathodes are produced as described in Example 1, except that the casting and rolling installation, the annealing furnace, the degreasing and pickling unit, the straightening and partitioning installation and the finishing installation are arranged in one production line. This eliminates the winding and unwinding of the mill-hard and soft-annealed starting sheet which is necessary in Examples 1 and 2. The copper sheet material consists of SF-Cu and is reduced by the milling operation to a thickness of 0.8 mm. The temperatures in the suspended belt furnace are also 750° C. to 720° C., the conveyance speed is 23 m/min. The soft annealed, cooled copper sheet has a tensile strength of 232 N/mm$^2$. The dimensions of the starting sheets are also 970×930 mm. The ears riveted on the starting sheets have a thickness of 0.6 mm.

Comparative Example

Starting Cathodes S4

Starting cathodes were produced under the same conditions as described in Example 1 but without soft annealing.

The starting cathodes produced according to the above-mentioned examples were used for electrolysis experiments and had the following parameters:

| Starting cathodes 970 × 930 mm of SF-Cu | | | | |
|---|---|---|---|---|
| | S1 | S2 | S3 | S4 |
| Sheet thickness, mm | 0.5 | 0.635 | 0.8 | 0.5 |
| Tensile strength, N/mm$^2$ | 217 | 217 | 232 | 263 |
| Ear thickness, mm | 0.4 | 0.5 | 0.6 | 0.4 |
| Soft annealed | yes | yes | yes | no |

Each electrolysis bath was equipped with 30 anodes and 31 cathodes. The anode spacing was 105 mm. The running time of one anode run was 21 days. A volume flow of 18 to 20 1/min was supplied per bath through the electrolyte inlet. The quality of the starting cathodes used was evaluated as follows.

A: Test of straightness of the starting sheets used and cathodes produced by performing measurements two days after starting operation B: Current efficiency of the respective bath after nine days.

C: Number of short circuits occurring.

The following results were obtained:

| | S1 | S2 | S3 | S4 |
|---|---|---|---|---|
| A | straight | straight | vertical up to 5 mm | vertical up to 20 mm |
| B | 99.18 | 98.38 | 96.56 | 95.82 |
| C | 2 | 1 | 4 | 6 |

These results prove that the starting cathodes S1 through S3 according to this invention dis not lead to a memory effect when used in copper electrolysis. In contrast with this, a memory effect occurred to a significant extent when the starting cathodes S4 which were not soft annealed were used in copper electrolysis. The best results were achieved with the starting cathodes S1, which are superior especially with regard to the current efficiency achieved.

What is claimed is:

1. Starting cathodes of copper sheet for copper electrolysis consisting of milled copper sheet made of grades of copper according to the DIN standards 1708, 1787 and 17670, with a thickness of 0.3 to 1.2 mm, soft annealed after milling and having a strength of 210 to 240 N/mm$^2$, and cut to the length and width determined by the dimensions of the electrolysis bath, where the sheet cut to size has a flat, fat-free, burless surface, and ear strips 0.3 to 0.6 mm thick are attached to the suspension side of the sheets.

2. Starting cathodes according to claim 1, wherein the starting cathodes are 0.5 to 0.8 mm thick, and the ear strips are 0.3 to 0.4 mm thick.

3. Starting cathodes according to claim 1, wherein the soft annealed copper sheet has a strength of 215 to 235 N/mm$^2$ after cooling.

4. A method of producing starting cathodes according to claim 1 comprising the following steps:

a) producing a milled, mill-hard copper sheet with a thickness of 0.3 to 12. mm made of grades of copper according to the DIN standards 1708, 1787 and 17670, b) soft annealing the mill-hard copper sheet at furnace temperatures of 700° C. to 750° C. at conveyance speeds of 20 to 70 m/min, c) degreasing the surfaces, d) cutting the cooled copper sheet to the desired starting sheet dimensions, e) mounting ear strips made of copper sheet 0.3 to 0.6 mm thick on the starting sheets and mounting the contact rods, and f) adjusting the starting cathodes by separating, sorting and suspending the starting cathodes in a prepared receptacle inserted into the electrolysis bath by a lifting device.

5. The method according to claim 4, wherein the mill-hard copper sheet manufactured according to process step a) is wound up to a coil.

6. The method according to claim 5, wherein the mill-hard copper sheet is unwound from a coil and processed further according to process steps b) through e) in a separate fabrication line that operates continuously.

7. The method according to claim 5, wherein the mill-hard copper sheet is unwound from a coil and processed further according to process steps b) through f) in a separate fabrication line which operates continuously.

8. The method according to claim 4, wherein the soft copper sheet manufactured according to process steps a) and b) is wound up into a coil.

9. The method according to claim 8, wherein the soft copper sheet is unwound from a coil and processed further according to process steps c) through e) in a separate fabrication line that operates continuously.

10. The method according to claim 8, wherein the soft copper sheet is unwound from a coil and processed further according to process steps c) through f) in a separate fabrication line that operates continuously.

11. The method according to claim 4, wherein the soft copper sheet is straightened before being cut to the desired starting sheet dimensions.

12. The method according to claim 4, wherein the soft annealing is performed in an annealing furnace of a horizontal or vertical design.

13. The method according to claim 4, wherein the soft annealing is performed under a protective gas or in a reducing atmosphere.

14. The method according to claim 4, wherein the copper sheet is degreased, brushed, rinsed and dried before soft annealing.

15. The method according to claim 4, wherein the copper sheet is cooled, pickled and neutralized after soft annealing.

16. The method according to claim 4, wherein the mill-hard copper sheet has a thickness of 0.4 to 0.5 mm and is conveyed through the annealing furnace at a speed of 25 to 35 m/min, where the heating zones are set at temperatures of 750° C. to 720° C.

17. The method according to claim 4, wherein the mill-hard copper sheet has a thickness of 0.6 to 0.8 mm and is conveyed through the annealing furnace at a speed of 20 to 30 m/min, where the heating zones are set at temperatures of 750° C. to 720° C.

* * * * *